United States Patent [19]

Stultz

[11] 4,163,440

[45] Aug. 7, 1979

[54] RADIANT HEATER

[75] Inventor: Hubert F. Stultz, Sale Creek, Tenn.

[73] Assignee: Suburban Manufacturing Company, Dayton, Tenn.

[21] Appl. No.: 796,019

[22] Filed: May 11, 1977

[51] Int. Cl.[2] ..... F24C 1/08

[52] U.S. Cl. ..... 126/60; 126/85 B; 126/77; 126/190

[58] Field of Search ..... 126/85 B, 77, 112, 190, 126/60; 237/79; 98/48

[56] References Cited

U.S. PATENT DOCUMENTS

| | | | |
|---|---|---|---|
| 2,584,404 | 2/1952 | Webb | 126/194 X |
| 2,765,120 | 10/1956 | Mascolo | 237/79 X |
| 3,064,638 | 11/1962 | Bauer | 126/85 B X |
| 3,120,225 | 2/1964 | Stark et al. | 126/85 B X |
| 3,168,088 | 2/1965 | Martin et al. | 126/77 |
| 3,490,756 | 1/1970 | Spier | 49/386 X |
| 3,521,582 | 7/1970 | Liden | 126/85 B X |
| 3,614,948 | 10/1971 | Jackson et al. | 126/85 B |

*Primary Examiner*—William E. Wayner
*Assistant Examiner*—William E. Tapolcai, Jr.
*Attorney, Agent, or Firm*—Nathaniel A. Humphries

[57] ABSTRACT

A radiant heater for burning firewood and the like to heat a living space such as a mobile home or house including an enclosure with a combustion compartment for the burning of the firewood placed in the combustion compartment, a flue pipe positioned outside the living space, an exhaust pipe extending through a wall of the living space and connecting the combustion compartment with the flue pipe, an outside air inlet having an opening to the outside wall surrounding the portion of the exhaust pipe extending through the wall to permit the exterior air coming through the inlet to cool the exhaust pipe and prevent overheating of the wall adjacent the exhaust pipe, an air passageway connecting the air inlet compartment with the combustion chamber, a thermostatically controlled damper in the passageway to control the rate of flow of air to the combustion compartment to achieve a desired heat output thereby providing a thermostatically controlled wood burning radiant heater which utilizes only outside air and automatic cooling of the exhaust pipe extending through a wall to prevent overheating of the wall.

2 Claims, 5 Drawing Figures

RADIANT HEATER

BACKGROUND OF THE INVENTION

This invention relates to radiant heaters and is more specifically directed to a wood burning radiant heater which thermostatically controls the rate of burning of the firewood and provides a means for cooling the wall adjacent the exhaust pipe to prevent overheating of the wall.

Prior known radiant heaters for use in mobile homes and the like have generally utilized combustion air drawn from within the living space. This arrangement has and can easily result in asphyxiation of the occupants of the rooms if insufficient air is drawn in from outdoors. This condition can easily occur in tightly constructed mobile homes. An additional disadvantage of previous radiant heaters has resulted from runaway combustion of firewood within the combustion compartment. Since these devices have generally utilized manual control of the inlet air, the hotter the compartment becomes, the faster the wood burns. Runaway burning has resulted in overheating of these devices and consequent fire in surrounding combustible material. A related problem with the previously known devices has been overheating of the exhaust pipe where it passes through a wall which has occasionally resulted in burning of combustible walls particularly in mobile homes.

SUMMARY OF THE INVENTION

Therefore, it is the object of the present invention to provide a new and improved radiant heater.

Another object of the present invention is to provide a wood burning radiant heater for mobile homes and the like which only utilizes combustion air external of the living space or room thereby eliminating the possibility of asphyxiation resulting from an insufficient supply of combustion air for the fire.

A further object of the present invention is to provide a radiant heater which thermostatically controls the supply of external air to the combustion compartment to control the rate of burning of combustibles within the compartment to prevent the development of excessive temperatures on the radiant heater which could result in the igniting of fires in surrounding combustible materials such as furniture and walls or in the burning of an unsuspecting adult or child who may come in contact with the radiant heater.

A still further object of the present invention is to provide a radiant heater having an exhaust pipe surrounded by an inlet compartment through which combustion air may be drawn from outside to cool the exhaust pipe thereby permitting its installation in a combustible exterior wall to overcome the danger of creating a fire in the exterior wall.

Another object of the present invention is to provide a wood burning radiant heater which maintains a comfortable temperature within a living space of a mobile home or the like without subjecting the occupants of the living space to potential asphyxiation or burning.

It is a still further object of the present invention to provide a radiant heater which significantly reduces the cost of heating by utilizing firewood which is available almost anywhere and naturally replenishes itself to provide a continuous supply.

DESCRIPTION OF DRAWINGS

A better understanding of the manner in which the preferred embodiment of the invention achieves the objects of the invention will be enabled when the following written description is read in conjunction with the appended drawings in which.

Figure 1:
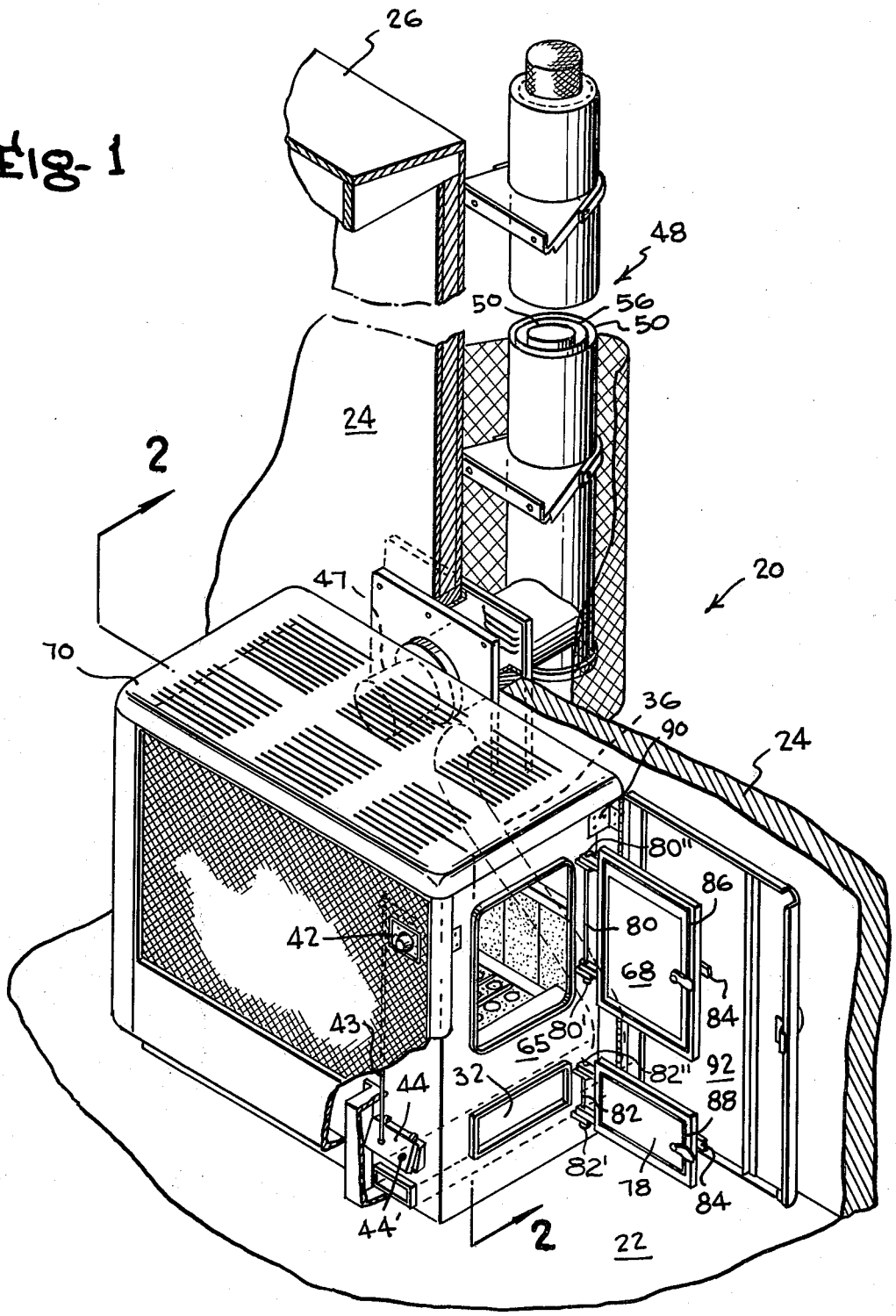
FIG. 1 is a perspective view of the preferred embodiment

As shown in attached FIGS. 1, 2, 3 and 4, the radiant heater, generally indicated with the reference numeral 20, is installed in a mobile home having a floor 22, a side wall 24, and ceiling or roof 26 of conventional construction. The radiant heater according to the present invention includes a combustion compartment 28 with a grate 30 having openings 31 through which air passes from an air chamber 32 to provide oxygen for firewood burning in the combustion chamber. The air chamber 32 is supplied with air drawn from outside the mobile home through an air inlet compartment 34 located in the side wall 24 of the mobile home. The air is drawn by natural convection from the inlet compartment through a first passageway 36 which connects with a second passageway 38 and then into an intake chamber 40 positioned below the combustion chamber 28 and adjacent the air chamber 32.

Figures 4, 5:
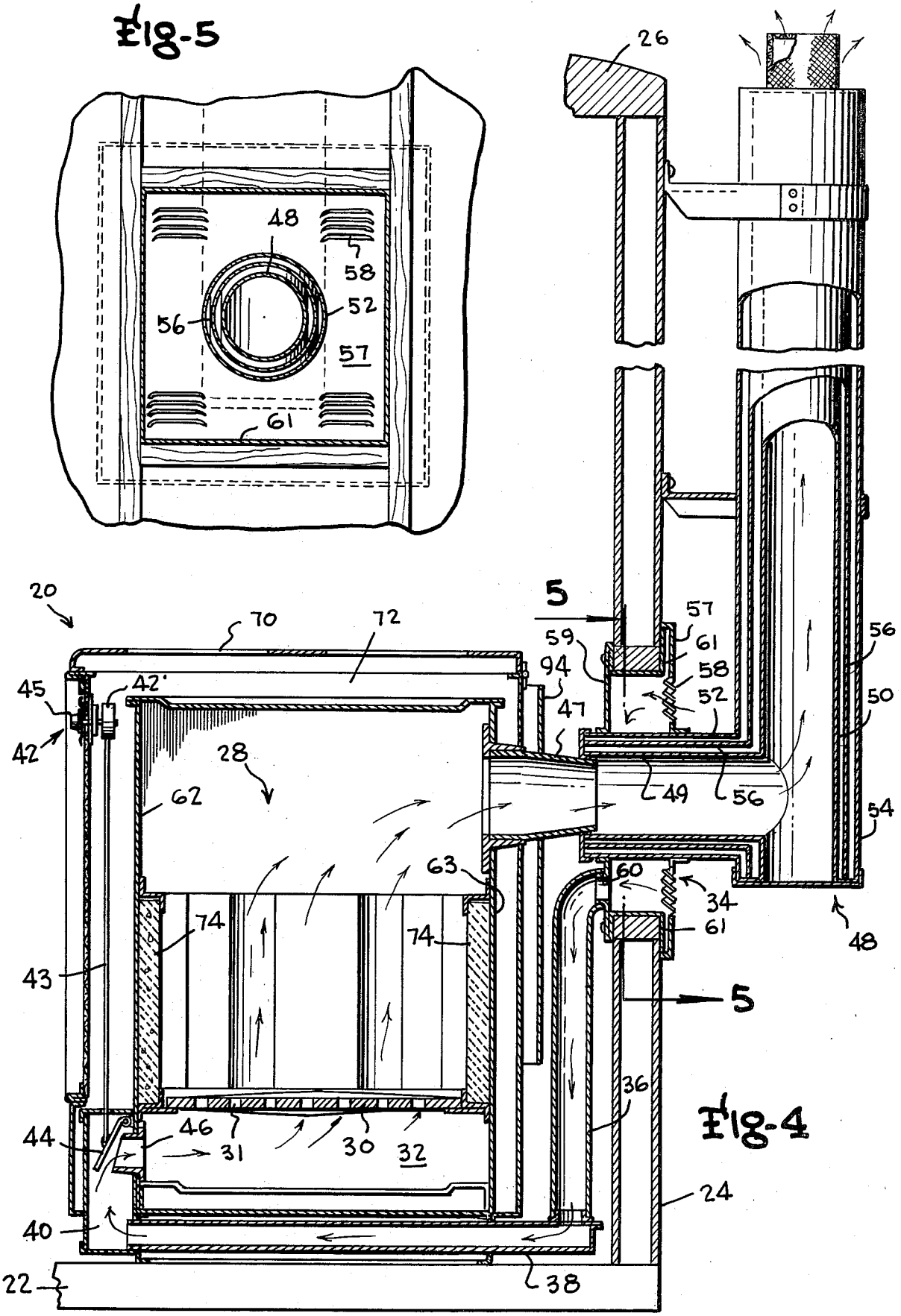
FIG. 4 is a cross-sectional view taken along line 4—4 in FIG. 2.
FIG. 5 is a cross-sectional view taken along line 5—5 in FIG. 4.

The flow of air from the intake chamber 40 into the air chamber 32 is controlled by an adjustable thermostat 42 including a spiral wound bimetallic strip 42' which moves a connecting link 43 to position a damper 44 at a desired location over an intake orifice 46 on the air chamber 32 as best shown in FIG. 4. An adjustment knob 45 on the thermostat 42 can be rotated to select the desired room temperature by appropriately orienting the bimetallic strip 42'. A small hole 44' is positioned in the damper to permit a controlled minimum flow of air into the combustion compartment when the damper is fully closed.

The products of combustion and gases flow from the combustion chamber 28 into an outlet 47, and through a conventional stainless steel chimney assembly 48 including an exhaust pipe 49 and a flue pipe 50 which are surrounded by concentric outer pipes 52 and 54 respectively with an inner concentric pipe 56 positioned between the inner and outer pipes to provide added protection against overheating of the wall 24.

As particularly shown in FIGS. 1, 4 and 5, the air inlet compartment 34 includes a rectangular exterior plate 57 having louvered openings 58 to admit the outside air, a rectangular interior plate 59 having a flanged outlet 60 on which the first passageway 36 is connected, and a protective flange 61 which extends through the wall 24 to cooperate with the exterior plate 57 and the interior plate 59 to form a compartment around the outer pipe 52 of the chimney assembly 48. This construction causes the outside air, drawn through the louvers 58 in the exterior plate 57, to cool the exhaust pipe 49 and concentric pipes 56 and 58 to prevent overheating of the wall 24.

Figure 2:
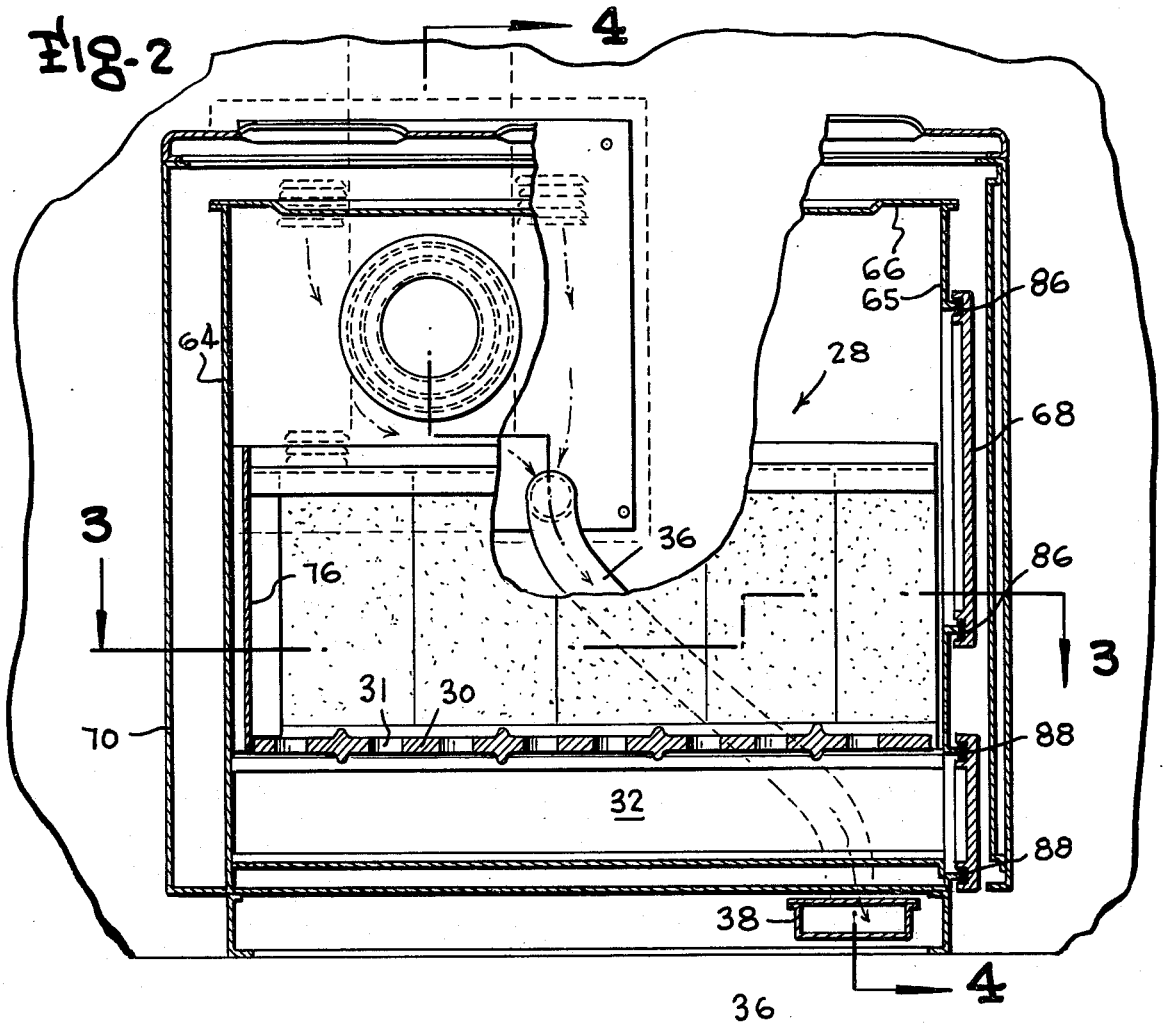
FIG. 2 is a cross-sectional view taken along line 2—2 in FIG. 1.

The combustion chamber has integral side walls 62 and 63, end walls 64 and 65 and top wall 66. A fuel door is hinged adjacent an opening through end wall 65 to permit the placing of firewood in the combustion chamber 28. The combustion chamber is surrounded by a heater cabinet 70 with an air space 72 between the walls of the combustion chamber and the heater cabinet to prevent any combustible material or human being from contacting the relatively hot walls of the combustion chamber. Fire bricks 74 are positioned along the lower portion of the side walls 62 and 63 to prevent overheating of the side walls. A heat baffle 76, as shown in FIGS. 2 and 3, is mounted adjacent the end wall 64 of the heater cabinet to prevent overheating of the end wall.

The air chamber 32 functions as an ash pit with access being provided by an ash door 78 as shown in FIG. 1. Torque rods 80 and 82 contact the end wall 65 at 80' and 82' respectively, the fuel door 68 at 80" and the ash door 78 at 82" to ensure closure of the doors when they are not manually held open. Conventional locking mechanisms 84 lock the doors in the closed positions as shown in FIG. 2. High temperature gaskets 86 and 88, positioned in recesses in the doors, provide seals between the fuel door 68 and the ash door 78, and the end wall 65 as shown in FIGS. 2 and 3.

Figure 3:
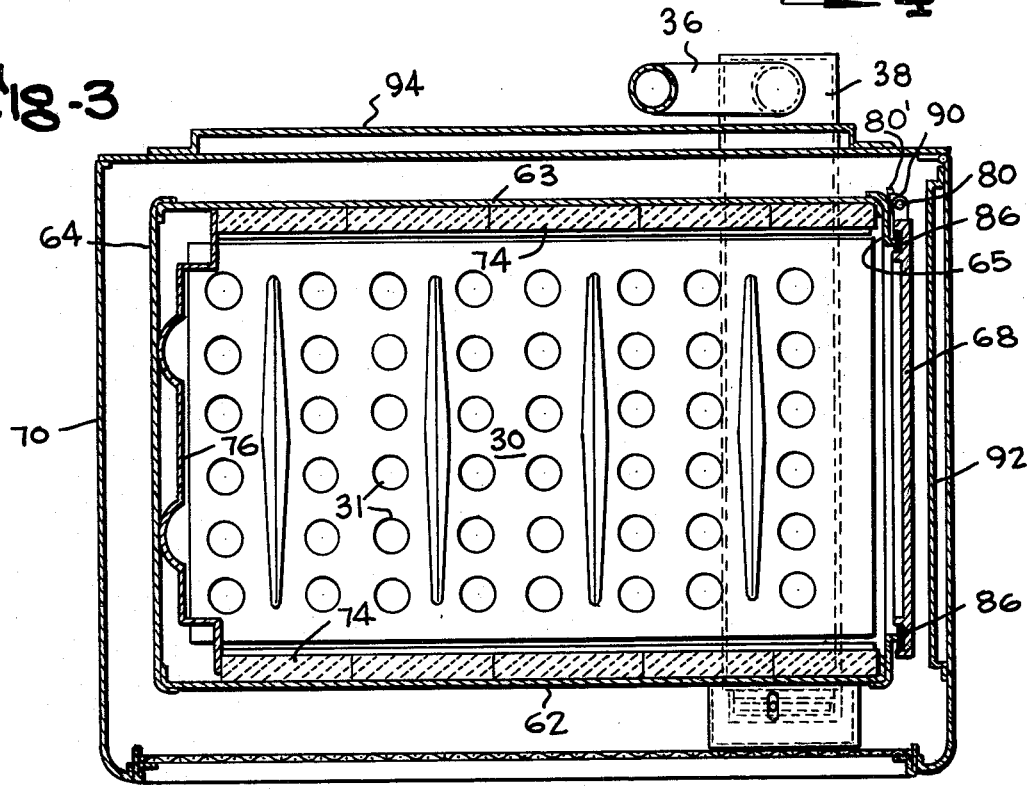
FIG. 3 is a cross-sectional view taken along line 3—3 in FIG. 2.

The end wall of the case 70 adjacent the fuel and ash doors is supported on hinges 90, as shown in FIGS. 1 and 3, to provide access to the fuel door 68 and ash door 78 and is provided with a baffle plate 92 to ensure a cool outer surface. An additional baffle cover 94, as shown in FIGS. 3 and 4, may be mounted on the rear wall of the case 70 to prevent overheating of the wall 24 caused by heat radiated from the rear wall of the case 70.

Operation of the radiant heater according to the present invention is easy and trouble free. Fire starting material such as paper and kindling wood is placed in the combustion compartment 28 and fire wood is placed on top of the starting material. The fire is lit and the thermostat 42 is set to the desired temperature. Since the thermostat is cold, the damper 44 will be wide open to admit the maximum amount of combustion air. With the fuel door, ash door and the case closed, outside air will be drawn through the louvered inlets 58 in the exterior plate 57 and around the concentric pipe 52 which surrounds the exhaust pipe 49. The air is then drawn through the first passageway 36, the second passageway 38, the opening between the damper 44 and the inlet 46, the air chamber 32 and the openings 31 in the grate 30 to provide combustion air for the firewood. As the temperature of the air in the space 72 between the case and the combustion compartment increases, the thermostat will gradually move the connecting link 43 to close the damper 44 thereby decreasing the supply of combustion air to the combustion compartment until the temperature is at the desired temperature. If the fire creates too much heat, the damper will close further to decrease the rate of combustion. If the fire begins to die down and not produce sufficient heat, the thermostat will open to supply additional air and increase the rate of combustion. The flow of combustion air provides continuous cooling of the portion of the chimney assembly 48 passing through the wall 24.

A radiant heater according to the present invention provides thermostatically controlled heat on a single load of firewood for periods up to 16 hours on a single load of firewood and completely burns the wood to ashes which may be easily removed once a week or so.

From the foregoing detailed description, it will be evident that there are a number of changes, adaptations and modifications of the present invention which come within the province of those skilled in the art. For example, the exhaust pipe can also extend through a ceiling wall or a floor wall. However, it is intended that all such variations, not departing from the spirit of the invention, be considered as within the scope thereof as limited solely by the appended claims.

I claim:

1. A radiant heater for burning firewood and the like to heat a living space, said radiant heater comprising an enclosure having a closed firewood combustion compartment with a fuel opening and an air inlet port through which air may pass to provide oxygen for supporting combustion of the firewood in the combustion compartment, a fuel door positioned to cover the fuel opening when the fuel door is closed, a torsion bar mounted on said enclosure with one end of the torsion bar positioned to engage the fuel door and the other end of the torsion bar positioned to engage the enclosure for forcing the door into a closed position when the door is not manually held open, said fuel door pivotally mounted on said torsion bar, a high temperature gasket surrounding the fuel opening and positioned between the fuel door and the combustion enclosure to seal the combustion compartment from the living space, an outer case surrounding the combustion enclosure for preventing contact thereof by any combustible material or persons, a baffle plate mounted on the case and spaced apart therefrom between the case and the wall of the living space to prevent the radiation of an excessive amount of heat to said wall, a flue pipe positioned outside the living space, an exhaust pipe extending through a wall of the living space, and connecting the combustion compartment with the flue pipe, an outside air inlet compartment having an opening to the outside and surrounding the portion of the exhaust pipe extending through said wall to permit air flowing through the outside air inlet compartment to cool the exhaust pipe, an air passageway duct connecting the air inlet compartment and the air inlet portion of the combustion chamber, a thermostatically controlled damper means in the passageway for controlling the rate of flow of air through the air passageway to achieve a desired heat output from the combustion enclosure thereby providing a thermostatically controlled radiant heater which utilizes only outside air for combustion and provides automatic cooling of the exhaust pipe extending through the wall to prevent overheating of the wall.

2. The radiant heater of claim 1 wherein the air inlet compartment includes an exterior plate mountable on an outside surface of said wall and having openings for admitting outside air, an interior plate mountable on an inside surface of said wall and having an outlet opening into said air passageway duct, and a protective flange extending through said wall, surrounding the portion of said exhaust pipe extending through the wall and cooperating with said exterior plate and said interior plate to form a compartment around the exhaust pipe.

* * * * *